US005549471A

United States Patent [19]

Tegtmeier et al.

[11] Patent Number: 5,549,471

[45] Date of Patent: Aug. 27, 1996

[54] COOLER GRATE FOR A RECIPROCATING GRATE COOLER

[75] Inventors: Gert Tegtmeier, Oelde, Germany; Manfred Strohbusch, Ennigerloh, Germany

[73] Assignee: Krupp Polysius AG, Beckum, Germany

[21] Appl. No.: 406,577

[22] Filed: Mar. 20, 1995

[30] Foreign Application Priority Data

Apr. 14, 1994 [DE] Germany ..... 44 12 885.1

[51] Int. Cl.[6] ..... F27D 15/02

[52] U.S. Cl. ..... 432/77; 432/78; 432/81; 432/82; 432/83; 432/233; 432/238; 432/244; 110/281

[58] Field of Search ..... 432/77, 78, 81, 432/82, 83, 233, 238, 244; 110/281

[56] References Cited

U.S. PATENT DOCUMENTS

| | | | |
|---|---|---|---|
| 4,624,636 | 11/1986 | Willis | 432/78 |
| 4,626,198 | 12/1986 | Cohen | 432/13 |
| 4,778,381 | 10/1988 | Heinemann et al. | 432/77 |
| 4,797,091 | 1/1989 | Neumann | 432/14 |
| 5,330,350 | 7/1994 | Tegtmeier | 432/77 |
| 5,332,434 | 7/1994 | Yooda et al. | 106/724 |

*Primary Examiner*—Henry A. Bennett
*Assistant Examiner*—Siddmarth Ohri
*Attorney, Agent, or Firm*—Learman & McCulloch

[57] ABSTRACT

The invention relates to a cooler grate for a reciprocating grate cooler, with a plurality of grate plate supports extending transversely with respect to the cooler grate and constructed as hollow bodies, on which in each case grate plates are supported so that they are co-ordinated in transverse rows and sealed by means of screw connections, wherein the grate plates have cooling gas openings and cooling gas connecting channels are constructed between the grate plate support and the cooling gas openings. Reliable sealing as well as quick installation of the grate plates is achieved in that each grate plate, so as to form a cooling gas connecting channel, has a hollow box-shaped lower part with a base wall which is in gas-tight form-locking engagement with the front long wall of the grate plate support, and that on the underside of each grate plate at least one tightening bolt engages, the said bolt passing through the rear long wall of the grate plate support towards the exterior and being clamped there by a bolt nut.

8 Claims, 4 Drawing Sheets

COOLER GRATE FOR A RECIPROCATING GRATE COOLER

The invention relates to a cooler grate for a reciprocating grate cooler which serves for cooling hot material to be cooled, according to the preamble to claim 1.

A cooler grate of the aforesaid type is known for instance from DE-A-41 34 242. In such a cooler grate for a reciprocating grate cooler the grate plate supports which are provided with transverse rows of grate plates are disposed at least on a substantial part of the length of the grate so that they are alternately stationary and movable to and fro in the longitudinal direction of the cooler grate, wherein the grate plates of transverse rows which are adjacent to one another in the longitudinal direction overlap, so that during operation the material to be cooled is transported along in the longitudinal direction of the cooler grate over the cooler grate surface formed by the grate plates or the upper support surfaces thereof and in the course of this a cooling gas, particularly cooling air, streams through it from below. In order in this case to ensure the desired forced delivery of cooling gas from the interior of the hollow grate plate supports to the cooling gas openings of the grate plates, in this known construction corresponding connecting channels are provided between the upper face of the grate plate supports and connecting channels adapted to the cooling gas openings. These connecting channels are delimited by a base plate, which is common to all grate plates, extends over the entire grate plate support and projects like a tongue from the upper part of the grate plate support, as well as by lower portions of the individual grate plate side walls, wherein the individual grate plates of each transverse row are fixed approximately like flanges on the appertaining grate plate support and are clamped in a gas-tight manner by outer screw connections to form a unit.

In another cooler grate construction (DE-A-38 12 425) the individual grate plates have in their front plate portion troughs which are open towards the top and have cooling gas openings opening into the vertical side faces thereof. On the hollow grate plate supports which are provided here, there is provided on the upper face thereof in each case an upper plate which has depressions running round it for better connection of the edges of the grate plates mounted thereon, the grate plates of a transverse row being screwed on the upper plate of the appertaining grate plate support and these upper plates extending over the entire extent of the grate plates in the longitudinal direction of the cooler grate so that in this way they also simultaneously form a type of base plate for cooling gas connecting channels.

Also in another known cooler grate (DE-A-37 34 043) a flat cover plate is fixed on the upper face of each hollow grate plate support. The portion of the cover plate which is at the front—when viewed in the direction of conveying the material to be cooled—has individual cooling gas openings, and on this front portion of the cover plate rest grate plates which are likewise of flat construction, provided with cooling gas openings and bent downwards at the front. These flat grate plates provided with projections which pass downwards through the cover plate and on which the tie bolts engage which extend as far as the interior of the appertaining grate plate support and are clamped there by means of spring-loaded nuts. Furthermore, a base wall, which extends from the grate plate support in the direction of conveying the material for cooling and delimits cooling gas connecting channels constructed above it, is also fixed with a clearance in the region below the front end of the cover plate.

With these known cooler grate constructions it always proves difficult to maintain a permanently gas-tight connection between the grate plates and the corresponding upper portions of the appertaining grate plate supports in the region of the cooling gas connecting channels. Furthermore, it should be noted that with cooler grates for a reciprocating grate cooler stationary transverse rows of grate plates alternate with transverse rows of grate plates which are movable to and fro, so that in each case the front portions of the grate plates together with the base plates, which are located below them, of the appertaining cooling gas connecting channels slide to and fro over the successive stationary transverse rows of grate plates, so that in the case of very abrasive material to be cooled, such as for example cement clinker, ore materials or the like, it is not possible to avoid having to replace, due to wear, not only individual worn grate plates but also at least the base plate of the connecting channels which is fixed at the upper end of the appertaining grate plate support. However, since in the known constructions described above this base plate extends over the entire length (in the transverse direction of the cooler grate) of the appertaining grate plate support, although this base plate is only worn on a part of its length, replacement of the entire base plate not only means a relatively high expenditure on reconstruction but also a disproportionately high material consumption. Since, moreover, with these known cooler grates either a relatively large number of screw connections is necessary for fixing the grate plates on the grate plate support or these screw connections are provided in the form of tie bolts within the grate plate supports, the replacement of worn grate plates also necessitates additional awkward and time-consuming installation work.

The object of the invention, therefore, is to make further developments to a cooler grate of the type set out in the preamble to claim 1 in such a way that, whilst largely avoiding wear on the grate plate support, on the one hand a permanent and reliable seal is ensured between the grate plates and the upper face of the appertaining grate plate support in each case and on the other hand a relatively simple and quick installation and dismantling of the grate plates is ensured.

This object is achieved according to the invention by the features set out in the characterising portion of claim 1.

Advantageous embodiments of the invention are the subject matter of the subordinate claims.

Whereas in the known constructions described above support plates which are continuous in the transverse direction of the cooler grate are fixed at the upper end of each grate plate, so that they form afixed part of the particular grate plate support and also form a continuous common base wall for the cooling gas connecting channels of all grate plates located above them, the present invention goes a different way. According to the invention, in fact, each grate plate is provided or constructed on its front plate portion—when viewed in the direction of conveying the material for cooling on the cooler grate—so as to form the appertaining cooling gas connecting channel, with a lower part which is in the shape of a box, the base wall of which—when viewed in the direction of conveying the material for cooling—is in gas-tight form-locking engagement by way of its rear edge region with an upper edge of the front long wall of the grate plate support facing it. In this way each grate plate has its own base wall in its lower part which is constructed as a cooling gas connecting channel. Thus when, in transverse regions of the cooler grate which are particularly susceptible to wear, worn grate plates and thus also correspondingly worn base walls regions or base walls of the appertaining cooling gas connecting channel must be replaced, then it is only necessary to replace the particular grate plate with its integrally constructed lower part and the integrally constructed, preferably integrally cast, base wall for the region of this worn grate plate. This represents a considerable simplification by comparison with the known constructions described above, both as regards the installation work and also as regards the material consumption, since each grate plate with its lower part and the cooling gas connecting channel constructed therein forms one component. However, it is also important here that the rear edge region of the base wall and the upper edge of the front long wall of the grate plate support facing the said edge region are adapted to one another and constructed so that they can be assembled into gas-tight form-locking engagement.

In the grate plate construction described above it is also particularly advantageous that on the underside of a rear plate portion of each grate plate in which no cooling gas openings are generally provided, at least one receiving part is firmly attached, particularly—in the case of cast grate plates—integrally cast thereon, and on this receiving part the head portion of a tightening bolt engages, for example is hooked therein, this bolt for its part—when viewed in the direction of conveying the material for cooling—passing through the rear long wall of the appertaining grate plate support towards the exterior and being clamped there by a bolt nut. In this way it is ensured above all that the lower part of the grate plate support with its base wall is firmly clamped to the upper edge of the front long wall of the grate plate support and thereby the gas-tight form-locking engagement is permanently and reliably maintained. Since, moreover, in this case each tightening bolt is fixed and clamped on the outer face of the rear long wall of the grate plate support by a bolt nut, at the same time an extremely simple and relatively quick installation and dismantling of individual grate plates is ensured.

According to an advantageous embodiment of the invention, the rear edge region of the base of each lower part of a grate plate has a cut-out which is open towards the front long wall of the grate plate support and has the cross-sectional shape of half a dovetail cut-out into which the correspondingly shaped upper edge of the front long wall of the grate plate support engages. By way of the form-locking engagement thus provided the thrust force which is necessary for the advance (in the case of the movement to and fro of the corresponding grate plate support with the grate plates fixed thereon) can also be transferred to the individual grate plates. Simultaneously, turning up of the appertaining grate plate during the said advancing movement is counteracted due to the configuration of this form-locking engagement.

With a view to an all-round reliable gas-tight clamping of each grate plate on the upper face of the appertaining grate plate support, it is also particularly advantageous if the tightening screw is guided obliquely through an inclined bore provided in the rear long wall of the grate plate support and machined into an abutment eye formed on this long wall, the bolt nut being supported by a compression spring, preferably a set of cup springs, on an outer abutment surface of the abutment eye. In this way the grate plate is clamped obliquely downwards on the one hand against the upper face of the grate plate support and on the other hand with the rear edge region of its base wall against the correspondingly shaped upper edge of the front long wall of the grate plate support, as has already been explained above.

The invention will be explained in greater detail below with the aid of the drawings, in which.

Figure 1:
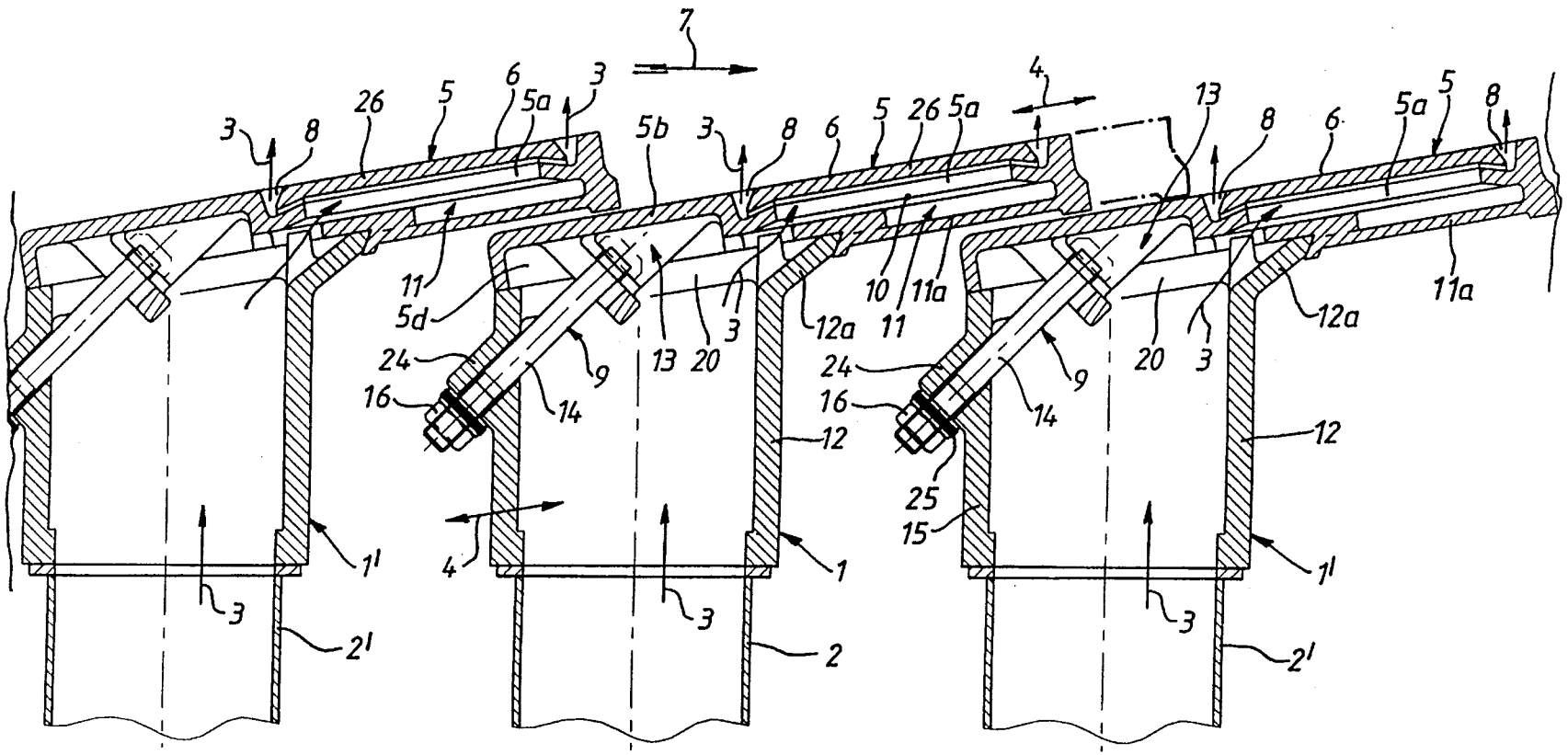
FIG. 1 shows a partial longitudinal sectional view through the cooler grate according to the invention.

In the partial longitudinal sectional view according to FIG. 1 the overall construction of the cooler grate which is essential for explaining the present invention can be seen within an appertaining reciprocating grate cooler which is intended for cooling hot material, for example previously burnt cement clinker, ore material or the like.

The cooler grate according to the invention contains a number of grate plate supports 1, 1' which are constructed in substantially the same way and of which only three are shown (in cross-section) in the drawing. These grate plate supports 1, 1' run transversely with respect to the cooler grate, i.e. perpendicular to the drawing plane according to the representation in FIG. 1. In this case the grate plate supports 1, 1' are disposed parallel and appropriately spaced from one another. Each grate plate support 1, 1' is—as FIGS. 1 and 2 make clear—constructed as a hollow body and connected to a cooling gas supply duct 2 or 2' respectively—only indicated in FIG. 1—through which cooling gas, particularly cooling air from any suitable source—as is known per se—is supplied to the interior of the grate plate supports 1, 1' according to the arrows 3.

Since this cooler grate is intended for a reciprocating grate cooler, the grate plate supports are held in a manner which is known per se at least over the greater part of the length of the cooler grate so that they are alternately stationary or movable to and fro in the longitudinal direction of the cooler grate on corresponding supports which are not shown in greater detail here. In the longitudinal portion of the cooler grate shown in FIG. 1 it may be assumed that the central grate plate support 1 is movable to and fro in the direction of the double arrows 4, whilst the two grate plates 1' disposed in front of it and behind it are each held stationary, and this is the sole difference between the illustrated grate plate supports 1 and 1'.

The cooler grate according to the invention also contains a plurality of grate plates 5 which are likewise of the same construction and which in each case are co-ordinated in transverse rows extending transversely with respect to the cooler grate—and thus in FIG. 1 perpendicular to the drawing plane—these grate plates having cooling gas openings 8 which open at the top in their upper support surfaces 6 for the material to be cooled at least in the front plate portions **5*a* which point in the direction of conveying the material to be cooled (arrow 7). In this case the grate plates 5 of each transverse row are co-ordinated so that they lie close against one another in a manner which is known per se, and each transverse row of grate plates is fixed and sealed by means of screw connections 9 on an appertaining grate plate support 1 or 1'—with appropriate spacing of the grate plate supports from one another—so that transverse rows of grate plates which are adjacent to one another in the longitudinal direction of the cooler grate (in the drawing plane of FIG. 1 from left to right) overlap one another like scales (approximately according to FIG. 1**).

Figure 4:
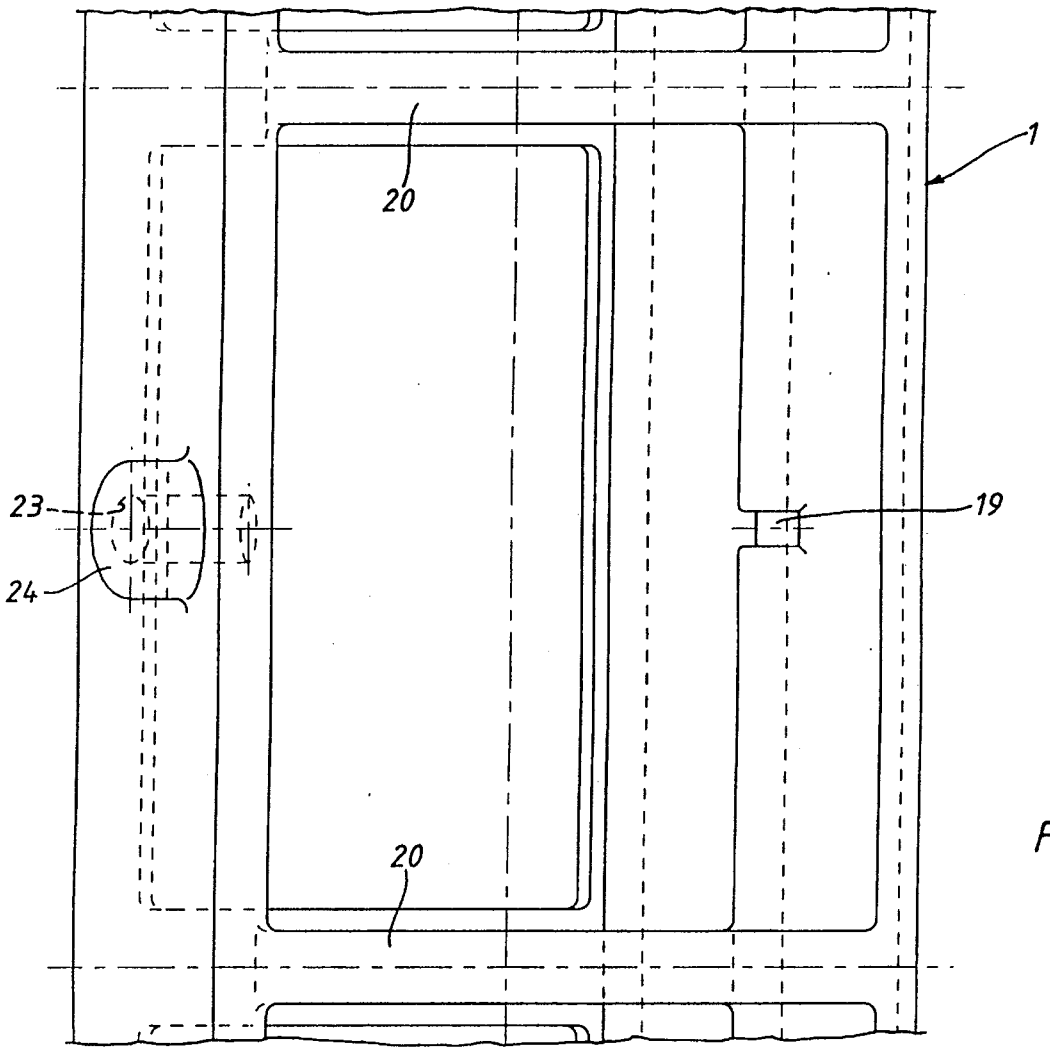
FIG. 4 shows a top view of a longitudinal portion of a grate plate support (according to the arrow IV in FIG. 2).

Furthermore, cooling gas connecting channels 10 are constructed in the region between the at least partially open upper face **1*a* (cf. FIGS. 2 and 4) of the grate plate supports 1, 1' and the cooling gas openings 8 of the appertaining grate plates 5 in order to be able forcibly to deliver cooling gas or cooling air according to the arrows 3 from the interior of the grate plate supports 1, 1' to the cooling gas openings 8 of the appertaining grate plates 5. In this way the cooling gas emerging at the top from the cooling gas openings 8 on the support surfaces 6 for the material to be cooled passes into the layer of hot material for cooling which is conveyed along over the grate plates 5 in the direction of the arrow 7 and thus on the cooler grate in order to cool this material in a manner which is known per se. As is further shown in FIG. 1 and particularly in FIG. 2, a first special feature of this cooler grate may be seen in the fact that each grate plate 5 is constructed on its front plate portion 5***a*, so as to form the appertaining cooling gas connecting channel 10 already mentioned, with a lower part 11 which is in the shape of a box, the approximately plate-shaped base wall 11*a* of which—when viewed in the direction of conveying the material for cooling (arrow 7)—is in gas-tight form-locking engagement by way of its rear edge region 11*a'* with an upper edge 12*a* of the front long wall 12 of the grate plate support 1, 1' facing it. In this case it is also important that for the screw connections 9 on the underside of a rear plate portion 5*b* (in the illustrated example the rear plate portion without cooling gas openings) of each grate plate 5 at least one receiving part 13 for the head portion 14*a* of a tightening bolt 14 is firmly attached, formed on integrally in the case where the grate plates 5 are produced as castings. As will be explained in somewhat greater detail below, the tightening bolt 14 is passed obliquely downwards and towards the exterior through the rear long wall 15 of the appertaining grate plate support 1, 1' and is clamped there by a bolt nut 16.

Figure 2:
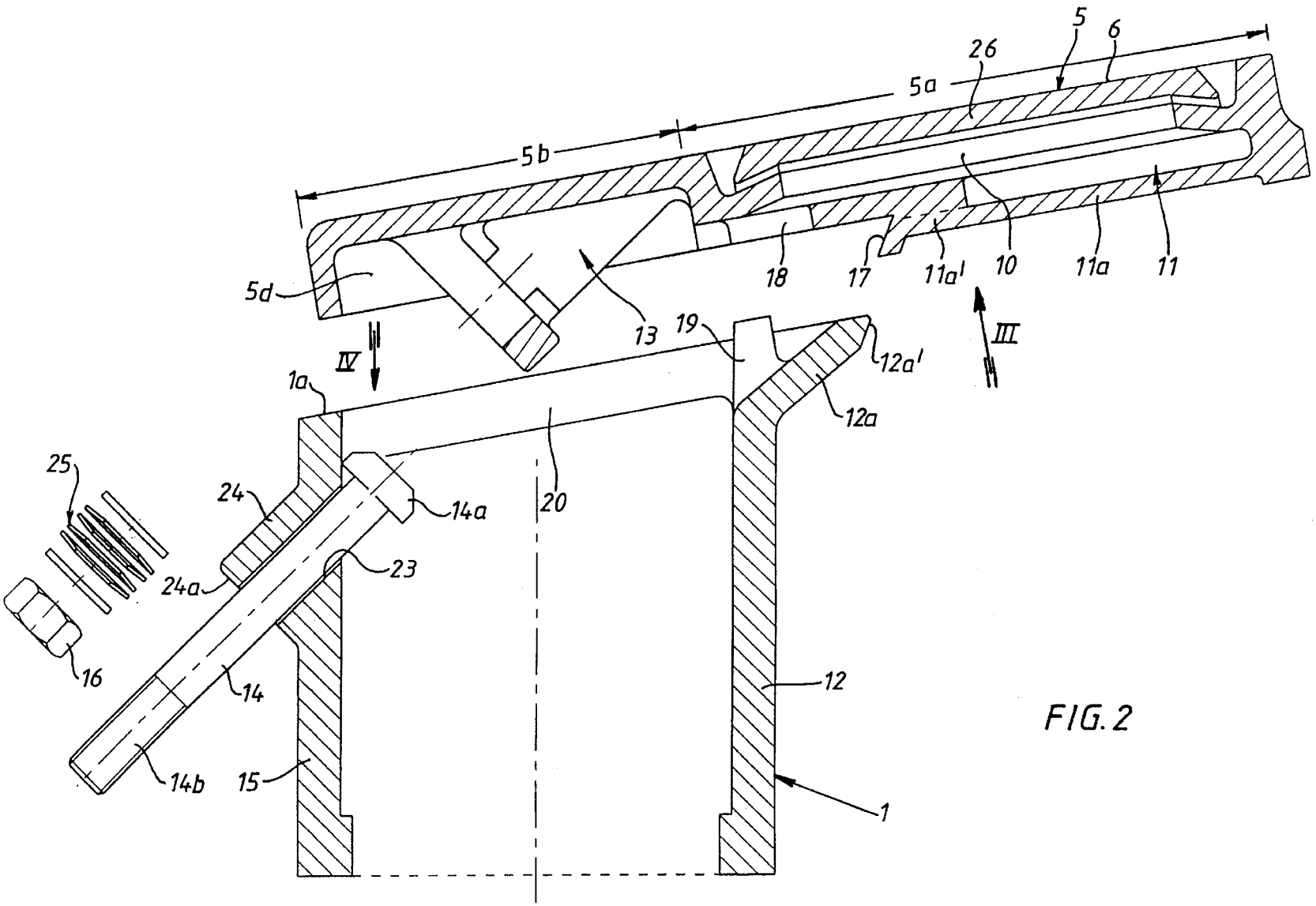
FIG. 2 shows an enlarged exploded sectional view of a grate plate support with appertaining grate plate (with similar sectioning to FIG. 1)

As can be seen particularly clearly from FIG. 2—but also visible in FIG. 1—the rear edge region 11*a'* of the base wall 11*a* of each grate plate has a cut-out 17 which is open towards the front long wall 12 of the appertaining grate plate support 1, 1' and has the cross-sectional shape approximately of half a dovetail cut-out (with corresponding undercutting). The upper edge 12*a*, which preferably projects upwards and outwards, of the front long wall 12 of the grate plate support has an outer edge 12' which is approximately wedge-shaped in cross-section corresponding to the cut-out 17 and with which the upper edge 12*a* engages in a form-locking and completely sealed manner in the cut-out 17.

In order that the or each grate plate 5 is also secured against lateral displacement (in the transverse direction of the cooler grate) on the appertaining portion of the grate plate support 1 or 1', a forked cut-out 18 is machined or formed on the rear edge region 11*a'* of the base wall 11*a* of the lower part in the region of the center of the length of the plate. A guide lug 19 which projects upwards from the upper edge 12*a* of the front long wall 12 of the grate plate support engages in a form-locking manner in this cut-out 18 so that a corresponding transverse guide is formed for the appertaining grate plate 5 (for more detail see also the representation in FIG. 4).

As has already been mentioned above, the grate plates 5 which are adjacent to one another lie closely against one another in each transverse row or on the appertaining grate plate support 1, 1'. However, in this case it is not always possible to prevent narrow gaps, into which fine material for cooling might penetrate, from remaining between adjacent grate plates 5 or between the two abutting side walls of each pair of adjacent grate plates. However, in order that below these gaps between adjacent grate plates 5 no material for cooling, so-called grate riddlings, can pass downwards into the grate plate supports 1, 1', each grate plate support 1, 1' has supporting flanges 20 which extend in the longitudinal direction of the cooler grate and close off flush with their upper faces and on which each pair of grate plates 5 which are adjacent to one another in the appertaining transverse row are supported in a gas-tight manner with their long sides 5*c*, 5*d* closely abutting one another. Accordingly the supporting flanges 20 are disposed at the upper end of each grate plate support 1, 1' in the transverse direction of the cooler grate (FIG. 4) with a spacing from one another which corresponds to the spacing of the long walls 5*c* and 5*d* of the grate plates (FIG. 3).

Figure 3:
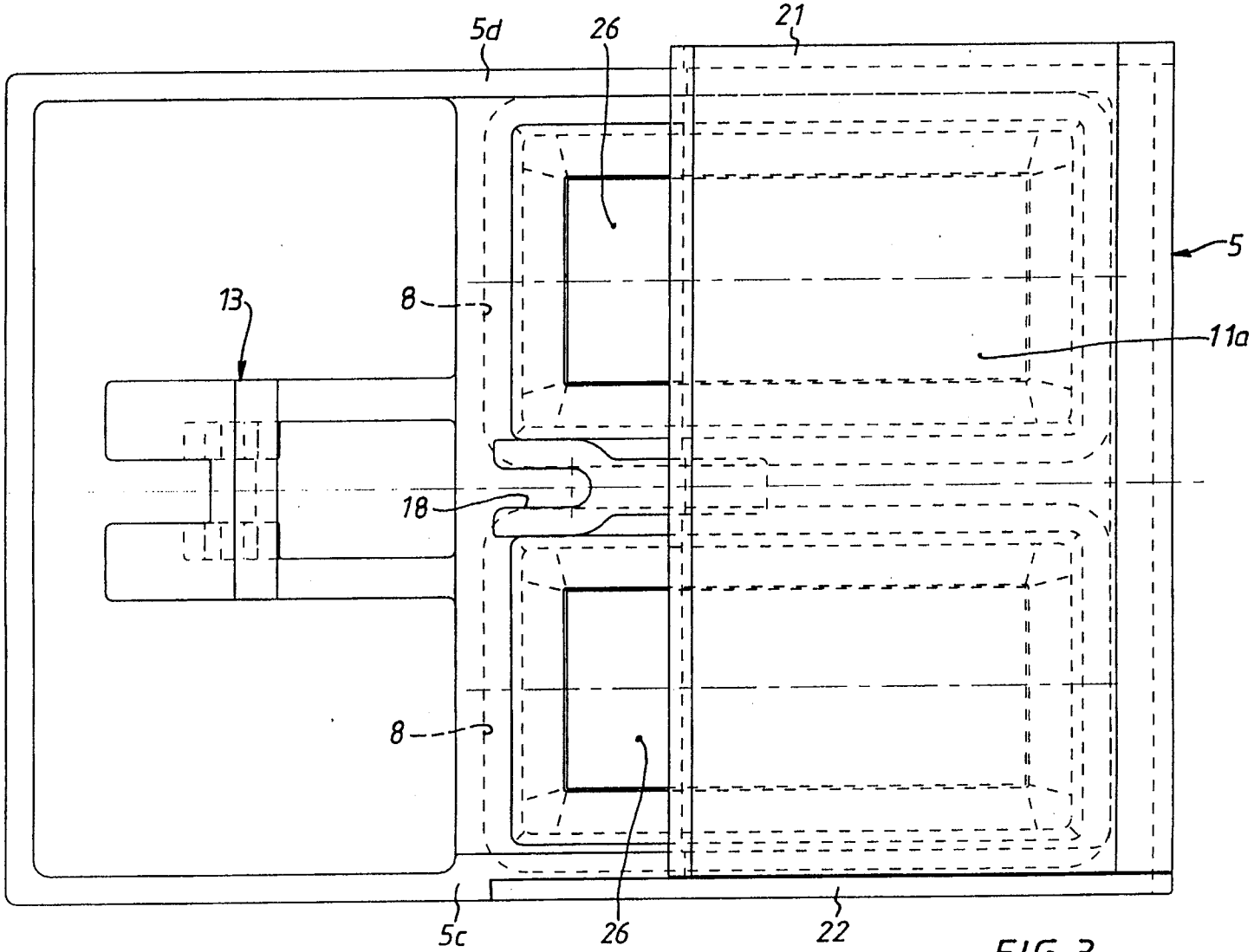
FIG. 3 shows a view from below of a grate plate (according to the arrow III in FIG. 2)

Furthermore, the penetration of fine material for cooling into the gaps between each pair of adjacent grate plates 5 of each transverse row can also be avoided as desired or additionally in that each grate plate 5—as shown in FIG. 3—has on one long side 5*d* thereof in the region of the base wall 11*a* a strip-shaped extension 21 projecting over this long side in the transverse direction and has on its opposing other long side 5*c* a recess 22 formed therein which is adapted in cross-section to the extension 21, in such a way that of the grate plates 5 co-ordinated in a transverse row the extensions 21 and recesses 22 which lie opposite one another of each pair of adjacent grate plates 5 interengage so as to fit and form a seal.

Finally, the screw connections 9 already mentioned above for releasably fixing the individual grate plates 5 on the appertaining grate plate supports 1, 1' should be described. According to the illustrated embodiment, each receiving part 13 is formed on the underside of the rear grate plate portions 5*b* by a receiving fork, which in the case of cast grate plates is preferably formed integrally thereon. Matching this, each tightening bolt 14 is formed by a commercially available hammer-head bolt of which the head or head part 14*a* is suspended in the receiving fork 13 so as to be releasable but secure against torsion, i.e. when the tightening bolt 14 is inserted it is pushed in axially between fork cams or the like into the receiving fork 13, turned by approximately 90° about its longitudinal axis and then fixed or suspended so as to be secure against torsion by pulling it back axially. In this case this tightening bolt 14 is passed downwards and obliquely according to FIGS. 1 and 2 through an oblique bore 23 provided in the rear long wall 15 of the grate plate support 1, 1'. This oblique bore 23 is machined into an abutment eye 24 formed externally on this long wall. The bolt nut 16 is screwed onto the threaded portion 14*b* of the tightening bolt 14 projecting outwards from the oblique bore 23, this bolt nut 16 being supported by way of a suitable compression spring, preferably a set of cup springs 25, on an outer abutment surface 24*a* of the abutment eye 24.

In the case of the construction features described above it should be clear that with the cooler grate according to the invention all cooler grates 5 can not only be screwed on the appertaining grate plate support 1, 1' or clamped thereto so as to be completely gas-tight and secure against tipping, but also that in case of need, particularly in the case of corresponding wear or corresponding damage, simply by undoing the bolt nut 16 which is easily accessible from the outside of each grate plate support 1, 1' the grate plates 5 can be quickly released and replaced, in fact as a unit with the lower part 11 of the grate plate constructed in the form of a cooling gas connecting channel, including the appertaining base wall 11*a* which is likewise exposed to wear.

In the construction of the individual grate plates it can also be particularly advantageous if in the upper part located above the hollow box-shaped lower part 11 of each grate plate 5, and in fact only in the front grate plate portion 5*a*, at least one separately fixed strip-shaped aerating cover cap 26 is fixed in such a way that the cooling gas openings 8 provided in this front grate plate portion 5*a* open at the top in the form of at least one substantially closed annular gap on the support surface 6 for the material for cooling. In the grate plate 5 illustrated in FIG. 3, two such cooling gas openings 8 like annular gaps are indicated by broken lines. In practical operation these cooling gas openings 8 act approximately in the form of ring slot nozzles, the action of which can be adjusted in relation to the cooling gas flowing through by an appropriate adjustment or configuration of the aerating cover caps 26.

What is claimed is:

1. Cooler grate for a reciprocating grate cooler which serves for cooling hot material to be cooled, comprising a) a plurality of grate plate supports (1, 1') which extend transversely with respect to the cooler grate as well as parallel to and spaced from one another, are constructed as hollow bodies and are connected to cooling gas supply ducts (2, 2'), b) a plurality of grate plates (5) which are co-ordinated in transverse rows and are provided with cooling gas openings (8) in the upper support surfaces (6) for the material to be cooled, at least in the front plate portions (5*a*) pointing in the direction of conveying the material to be cooled, c) wherein the grate plates (5) of each transverse row are fixed on a grate plate support (1, 1') by means of screw connections (9) so as to be sealed in such a way that transverse rows of grate plates which are adjacent to one another in the longitudinal direction of the cooler grate overlap one another, d) and wherein in the region between the at least partially open upper face (1*a*) of the grate plate supports (1, 1') and the cooling gas openings (8) of the appertaining grate plates (5) connecting channels (10) are constructed for forced supply of cooling gas (3) from the interior of the grate plate supports to the cooling gas openings, characterised by the following features:

e) each grate plate (5) is provided on its front plate portion (5*a*), so as to form the appertaining cooling gas connecting channel (10, with a lower part (11) which is in the shape of a box, the base wall (11*a*) of which—when viewed in the direction of conveying the material for cooling—is in gas-tight form-locking engagement by way of its rear edge region (11*a'*) with an upper edge (12*a*) of the front long wall (12) of the grate plate support facing it;

f) on the underside of a rear plate portion (5*b*) of each grate plate (5) at least one receiving part (13) for the head portion (14*a*) of a tightening bolt (14) is firmly attached, this bolt passing through the rear long wall (15) of the grate plate support towards the exterior and being clamped there by a bolt nut (16).

2. Cooler grate as claimed in claim 1, characterised in that the rear edge region (11*a'*) of the base wall (11*a*) of the lower part (11) of the grate plate has a cut-out (17) which is open towards the front long wall (12) of the grate plate support and has the cross-sectional shape of half a dovetail cut-out into which the correspondingly shaped upper edge (12*a*) of this front long wall (12) engages.

3. Cooler grate as claimed in claim 2, characterised in that on the rear edge region (11*a'*) of the base wall (11*a*) of the lower part a forked cut-out (18) is provided—preferably in the region of the center of the length of the plate—and a guide lug (19) projecting upwards from the upper edge (12*a*) of the front long wall (12) of the grate plate support engages in a form-locking manner in this forked cut-out so as to form a transverse guide for the grate plate (5).

4. Cooler grate as claimed in claim 1, characterised in that each grate plate support (1, 1') has supporting flanges (20) which extend in the longitudinal direction of the cooler grate and close off flush with their upper face (1*a*) and by which each pair of grate plates (5) which are adjacent to one another in an appertaining transverse row are supported in a gas-tight manner on their long sides (5*c*, 5*d*) which closely abut one another.

5. Cooler grate as claimed in claim 1, characterised in that each grate plate (5) has on one long side (5*d*) thereof in the region of the base wall (11*a*) a strip-shaped extension (21) projecting over this long side in the transverse direction and has on its opposing other long side (5*c*) a recess (22) formed therein which is adapted in cross-section to the extension in such a way that of the grate plates (5) co-ordinated in a transverse row the extensions and recesses which lie opposite one another of each pair of adjacent grate plate (5) interengage so as to form a seal.

6. Cooler grate as claimed in claim 1, characterised in that the receiving part (13) is formed on the underside of each rear grate plate portion (5*b*) by a receiving fork—which is preferably formed integrally thereon—and the tightening bolt (14) is formed by a commercially available hammer-head bolt, the head (14*a*) of which is suspended in the receiving fork so as to be releasable but secure against torsion.

7. Cooler grate as claimed in claim 1, characterised in that the tightening bolt (14) is passed obliquely through an oblique bore (23) provided in the rear long wall (15) of the grate plate support, this bore being machined into an abutment eye (24) formed integrally on this long wall, wherein the bolt nut (16) is supported by way of a compression spring, preferably a set of cup springs (25), on an outer abutment surface (24*a*) of the abutment eye.

8. Cooler grate as claimed in claim 1, characterised in that at least one separately fixed strip-shaped aerating cover cap (26) is fitted into the upper part located above the hollow box-shaped lower part (11) of each grate plate (5) in such a way that the cooling gas openings (8) open at the top in the form of at least one substantially closed annular gap on the support surface (6) for the material for cooling.

* * * * *